United States Patent [19]

Schützle

[11] Patent Number: 4,603,475

[45] Date of Patent: Aug. 5, 1986

[54] ELECTRIC PLUG CONNECTOR AND METHOD OF MANUFACTURING

[75] Inventor: Günter Schützle, Heilbronn, Fed. Rep. of Germany

[73] Assignee: Allied Corporation, Morris Township, Morris County, N.J.

[21] Appl. No.: 724,060

[22] Filed: Apr. 19, 1985

Related U.S. Application Data

[63] Continuation of Ser. No. 295,775, Aug. 24, 1981, abandoned.

[30] Foreign Application Priority Data

Aug. 29, 1980 [DE] Fed. Rep. of Germany ..... 3032585

[51] Int. Cl.[4] ..... H01R 43/00; H01R 11/20

[52] U.S. Cl. ..... 29/857; 339/99 R

[58] Field of Search ..... 29/844, 845, 857, 874, 29/882, 889; 339/97 R, 98, 99 R, 138

[56] References Cited

U.S. PATENT DOCUMENTS 3,879,099 4/1975 Schaffer ..... 339/138 X
4,171,858 10/1979 Knowles et al. ..... 339/99 R
4,241,970 12/1980 Rider, Jr. et al. ..... 339/99 R
4,253,722 3/1981 Fox, Jr. ..... 29/857 X

FOREIGN PATENT DOCUMENTS 2626631 1/1977 Fed. Rep. of Germany .
2738869 3/1979 Fed. Rep. of Germany .
1486404 9/1977 United Kingdom .
2033676 5/1980 United Kingdom .

*Primary Examiner*—Howard N. Goldberg
*Assistant Examiner*—Carl J. Arbes
*Attorney, Agent, or Firm*—Roger H. Criss

[57] ABSTRACT

An electrical connector for a flat cable. The connector includes a plurality of contact elements and a body having chambers for receiving the contact elements. Each contact element has a contact part for contacting other connectors, a connecting part for coupling to the flat cable and a middle part connecting the contact part and the connecting part, the connecting part being formed by bending about an axis which is essentially parallel to a major axis of the contact part after the associated contact element is received in its associated contact chamber.

15 Claims, 29 Drawing Figures

FIG. 2
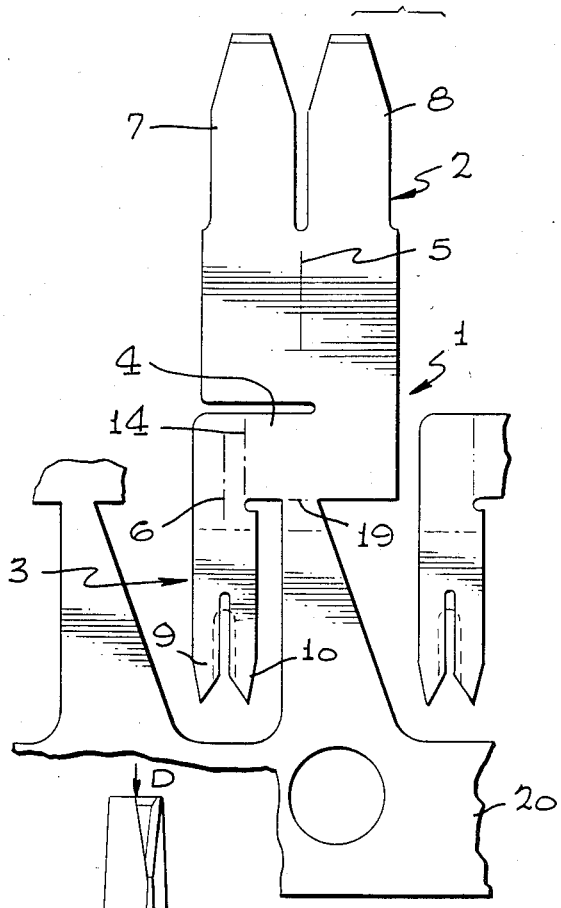
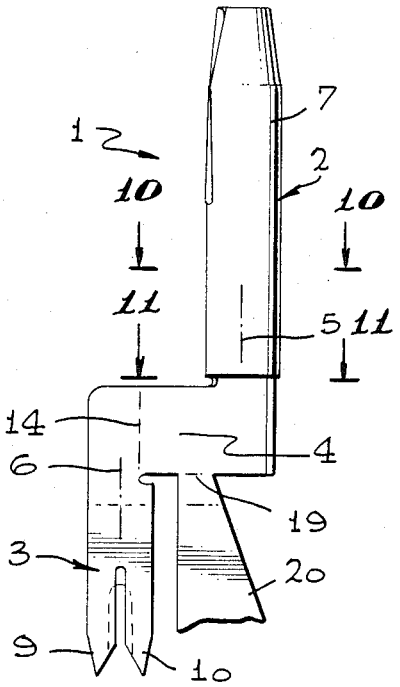
FIG. 3
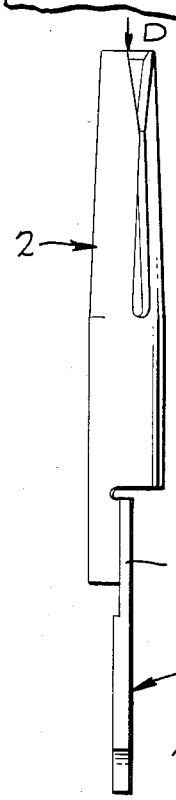
FIG. 4
FIG. 5
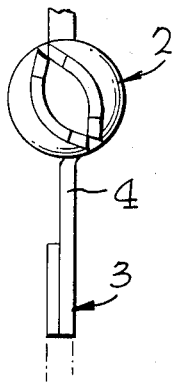
FIG. 10
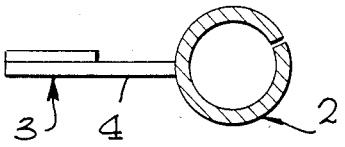
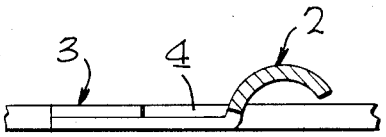
FIG. 11

FIG. 6
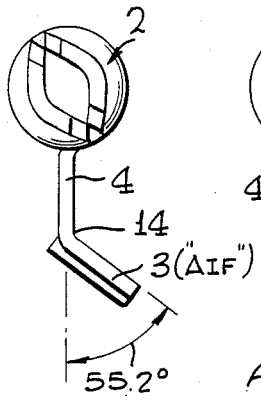
FIG. 7
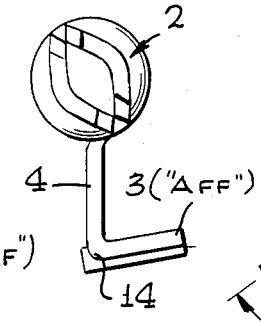
FIG. 8
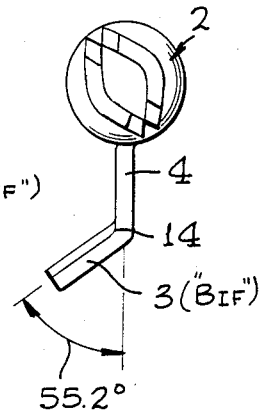
FIG. 9
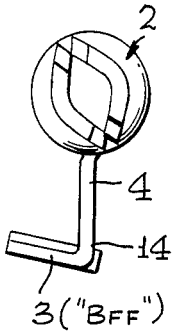
FIG. 12
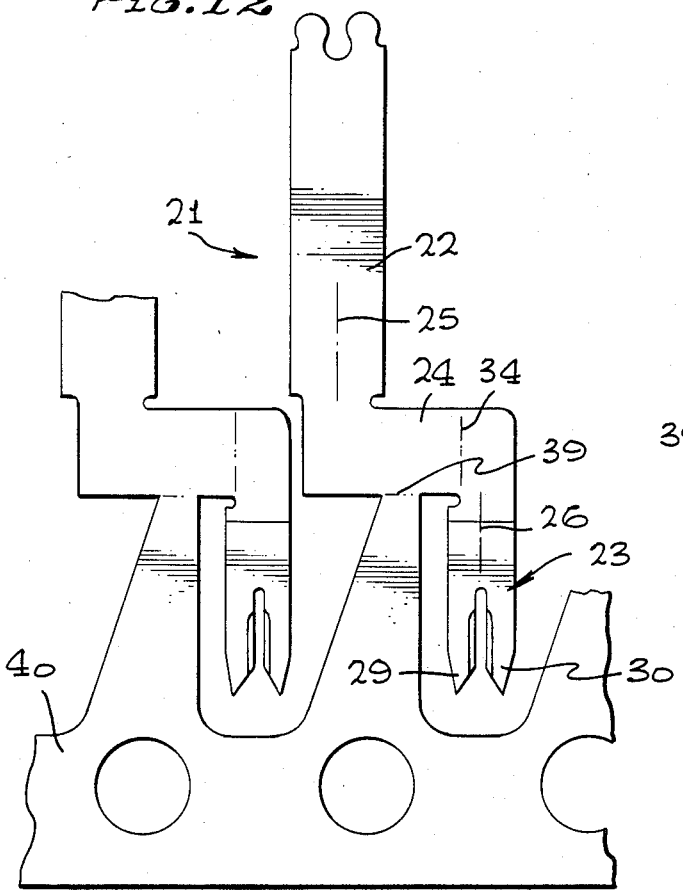
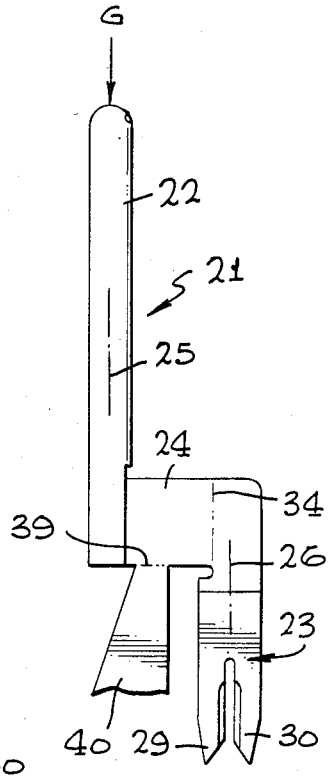
FIG. 13

FIG. 14
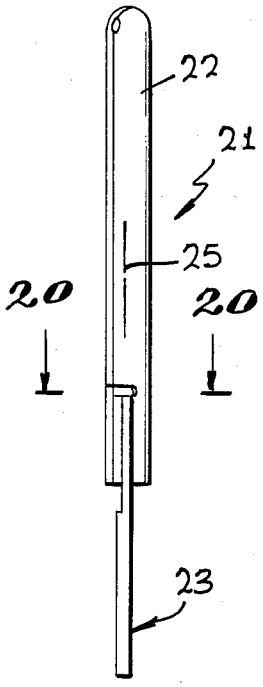
FIG. 15
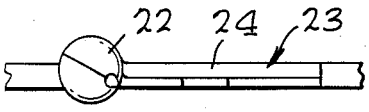
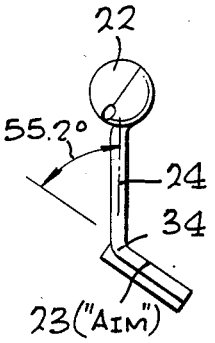
FIG. 16
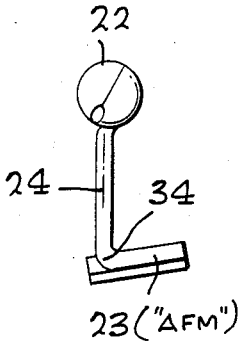
FIG. 17
FIG. 18
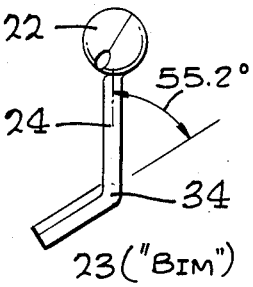
FIG. 19
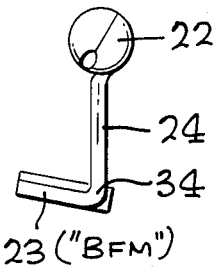
FIG. 20
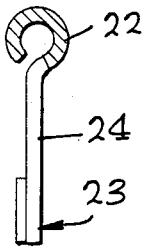
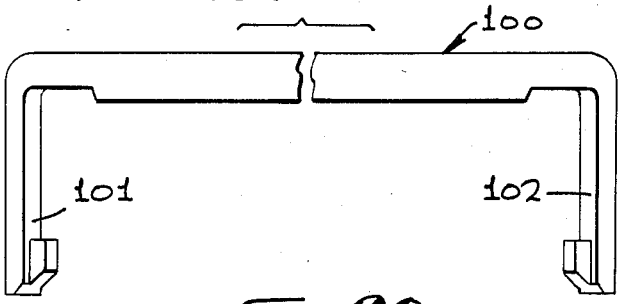
FIG. 29

ELECTRIC PLUG CONNECTOR AND METHOD OF MANUFACTURING

This application is a continuation of application Ser. No. 295,775 filed Aug. 24, 1981 now abandoned.

TECHNICAL FIELD

This invention relates to an electric plug connector for a flat cable in particular, an electric plug connector having electrical contacts having a spacing interval which is different than the spacing interval of the conductors in the flat cable. The plug connector has an insulating body with contact chambers for receiving electrical contact elements, each contact element having a contact part, a middle part and a connecting part.

BACKGROUND OF THE INVENTION

German Auslegeschrift No. 2626631 (which is believed to correspond to U.S. Pat. No. 3,990,767) discloses a plug connector for a flat cable in which in the middle part of each contact element is bent as required to compensate for the differential spacing of the individual wires of the flat cable compared to the spacing of the contact elements of the connector. The contact elements, before being inserted into the contact chambers in an insulating body of the connector, must either be bent individually for each contact chamber into the proper shape for use, or, on the other hand, be shaped with the correct bending for a particular contact chamber and grasped by a complicated mounting tool for insertion into the contact chamber. No provision is made for bending the contact elements after installation in the contact chambers. This prior art plug connector is relatively difficult to manufacture because of the need to either individually shape the contact elements or the need for a complicated mounting tool to correctly insert the many possible different shapes of mass-produced contact elements. A further disadvantage of this plug connector occurs in the fact that its middle part must be constructed quite elongated so that it can be properly bent. This results in an unduly large plug connector.

Another disadvantage of this prior art plug connector resides in the fact that the contact elements lying in the center of the contact panel are longer than the contact elements lying on the edges of the contact panel. This results from the varied degree of bending required of the middle parts of the connectors to place the contact parts and the connecting parts in the appropriate serviceable positions. Thus, either the plug elements in the insulating body must be arranged in an arch so as to place their connecting ends on a plane or conversely the connecting ends must be arranged in an arch so as to place the plug elements on a plane. In the event the connecting ends do not lie on a plane, the connecting wires must be pushed to varying degrees into the terminals resulting in contacting forces of varying magnitudes and concomitant varying contact resistence between the contacting elements and the connecting wires. In the event that the contacting elements are placed on a plane to avoid the aforementioned problem, then the contact elements do not lie on a plane and varying degrees of contact occur. This results in large tolerances for the depth of insertion of the male contact parts into the female contact parts so that the desired margin of safety for contact insertion may not be met.

An electrical contact installation is described in German Offenlegungsschrift No. 2737328 (which is believed to correspond to U.S. Pat. No. 4,062,616), in which the contact components have, in each case, an elongated bendable shank which is located between the contact part and the connecting part. The distance between the contact part and the connecting part is relatively long which results in a plug of relatively large size and the concomitant need for an increased amount of space to set it into its serviceable position.

There is also known a plug connector in which the middle part of the contact elements must be individually bent into the desired form for use by means of a rather complicated tool either before or after insertion into the assigned contact chambers. Subsequent adjustment of the bending of such contact elements is not possible.

It was, therefore, one object of the present invention to provide an electric connector for a flat cable which can be produced more simply and more economically than prior art connectors. It was another object to provide a plug connector for a flat cable having a shorter overall length than prior art connectors and to provide a plug connector which may be produced with fewer mechanical operations than required to produce prior art connectors. It was a further object of the present invention to provide an electrical connector for a flat cable having provisions for automatically spacing the connecting part of the contact elements to the spacing of the conductors in the flat cable by means of simple open dies in preferably a single pressing operation.

The foregoing objects are achieved as is now described. The electric plug connector for a flat cable includes an insulating body having contact chambers therein for receiving electrical contact elements. Each electrical contact element has a contact part for making contact with other connectors, a middle part and coupled to the contact part a connecting part coupled to the middle part, the connecting part being adapted to make contact a conductor in the flat cable. After a contact element has been inserted into a contact chamber, its connecting part is bent around an axis which is essentially parallel to the major axis of the contact part of the contact element.

BRIEF DESCRIPTION OF THE DRAWINGS

The novel features believed characteristic of the invention are set forth in the appended claims. The invention itself, however, as well as the preferred mode of use, further objects and advantages thereof will be best understood by reference to the following detailed description of the illustrative enbodiment when read in conjunction with the accompaning drawings, wherein:

FIG. 2 depicts a female contact element which has been stamped out of a sheet of metal and before it has been formed into the appropriate shape;

FIGS. 3–11 show the female contact element of FIG. 2 after subsequent forming operations have been performed thereon;

FIG. 12 depicts a male contact element which has been stamped out of a sheet of metal and before it has been formed into the the appropriate shape;

FIGS. 13–20 show the male contact element of FIG. 12 after subsequent forming operations have been performed thereon;

FIG. 24 is a sectional view through the connector taken as shown in FIG. 23 but with holding part 80 first removed from the connector;

FIG. 29 is a side-elevational view of retaining clip 100.

DETAILED DESCRIPTION OF AN ILLUSTRATIVE EMBODIMENT

Figure 1:
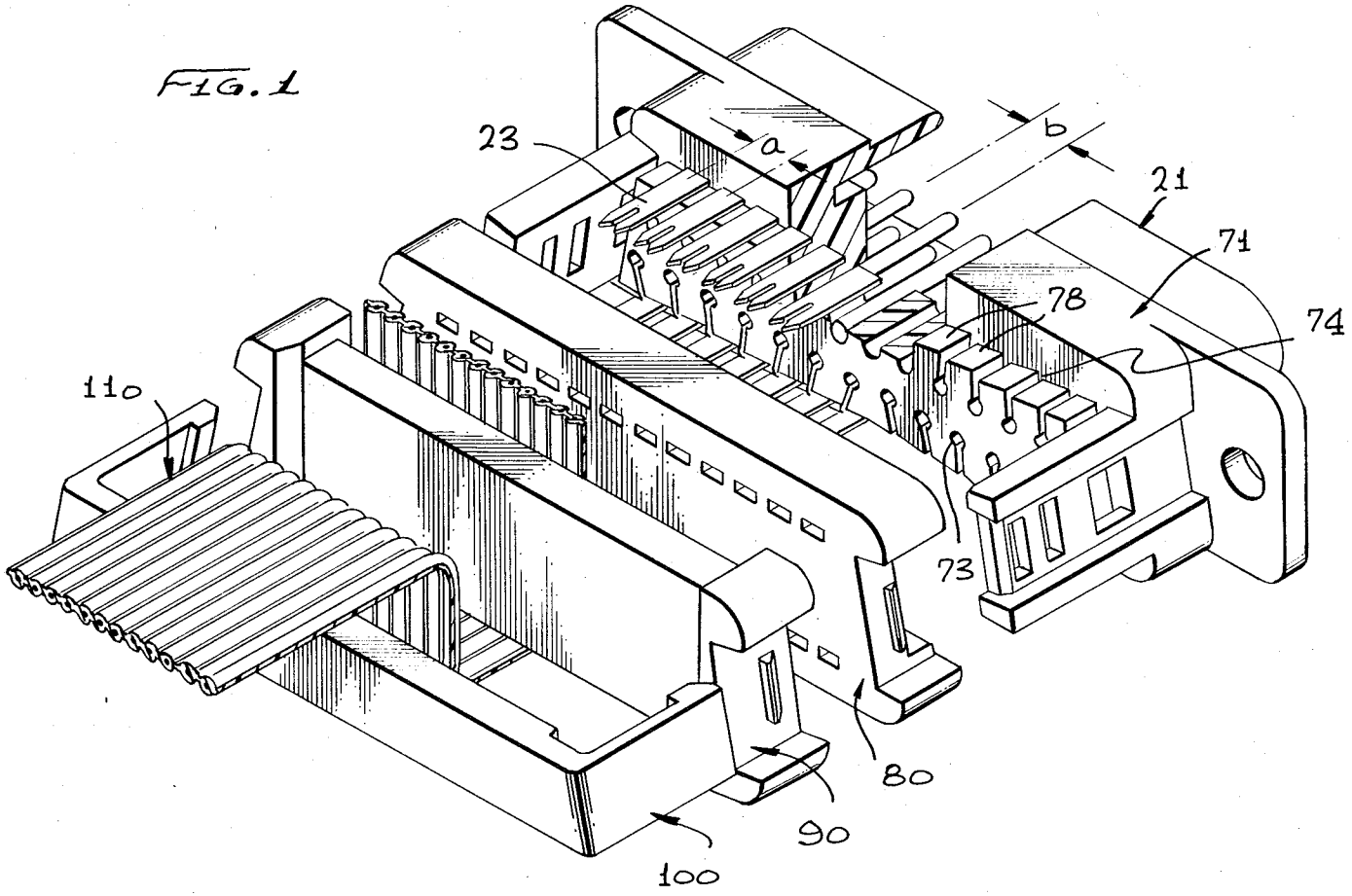
FIG. 1 is an exploded perspective view of the connector.

FIG. 1 is an exploded perspective view of a connector for a flat cable which employs applicant's invention. The connector includes an insulating body 71 which has a plurality of contact chambers 73, therein for receiving female contact elements 1 (which are better shown in FIGS. 2–11) or male contact elements 21 (better shown in FIGS. 12–20), along lines 10—10 and 11—11 respectively. The connector depicted in FIG. 1 is shown with male contact elements 21 disposed in several of the contact chambers 73. Of course, in actual use, the contact chambers 73 in insulating body 71 would all be filled with appropriate contact elements. The male contact elements 21 include a contact part 22, a connecting part 23 and a middle part 24 for interconnecting the contact part 22 with the connecting part 23 (see FIGS. 12–20).

Holding part 80 includes apertures for receiving the connecting parts 23 of the contact elements 21. The holding part helps to retain contact elements 21 in their proper places. The flat cable 110 is disposed between holding part 80 and pressure piece 90. The terminal ends 29 and 30 (see FIG. 12) of connecting part 23 engage the electrical conductors in flat cable 110 and make direct electrical contact therewith by cutting through the insulation of each conductor in flat cable 110. Preferably a loop is provided in the end of flat cable 110 so as to provide stress relief. This loop is disposed around pressure piece 90 and is held fast by means of the yolk-shaped retaining clip 100. The ends 101 and 102 (FIG. 29) of retaining clip 100 span the pressure piece 80 and holding part 80 and lock into insulating body 71, thereby locking the entire assembly together.

Turning now to FIGS. 2–11, the construction of the female contact elements 1 will be described. FIG. 2 shows the outline of an unfinished form of a female contact element 1, which is preferably stamped out of a punching strip 20. Element 1 includes a contact part 2, a connecting part 3 and a middle part 4 which is disposed between the contact and connecting part and runs essentially perpendicular to the axis 5 of the contact part 2 and axis 6 of the connecting part 3. Preferably, contact element 1 remains connected to punching strip 20 at plate 19 during the subsequent forming steps of mass production.

Contact part 2 has two contact spring parts 7 and 8 which are bent to form a female socket member as is shown in FIGS. 3–5. The free end of connecting part 3 has two terminal members 9 and 10 which are separated in a dove-tail fashion and which are provided for the subsequent reception of the insulated conductor of flat cable 110. As has already been indicated, members 9 and 10 bite into the insulation of the conductor and make direct electrical connection to the conductor.

Figure 8A:
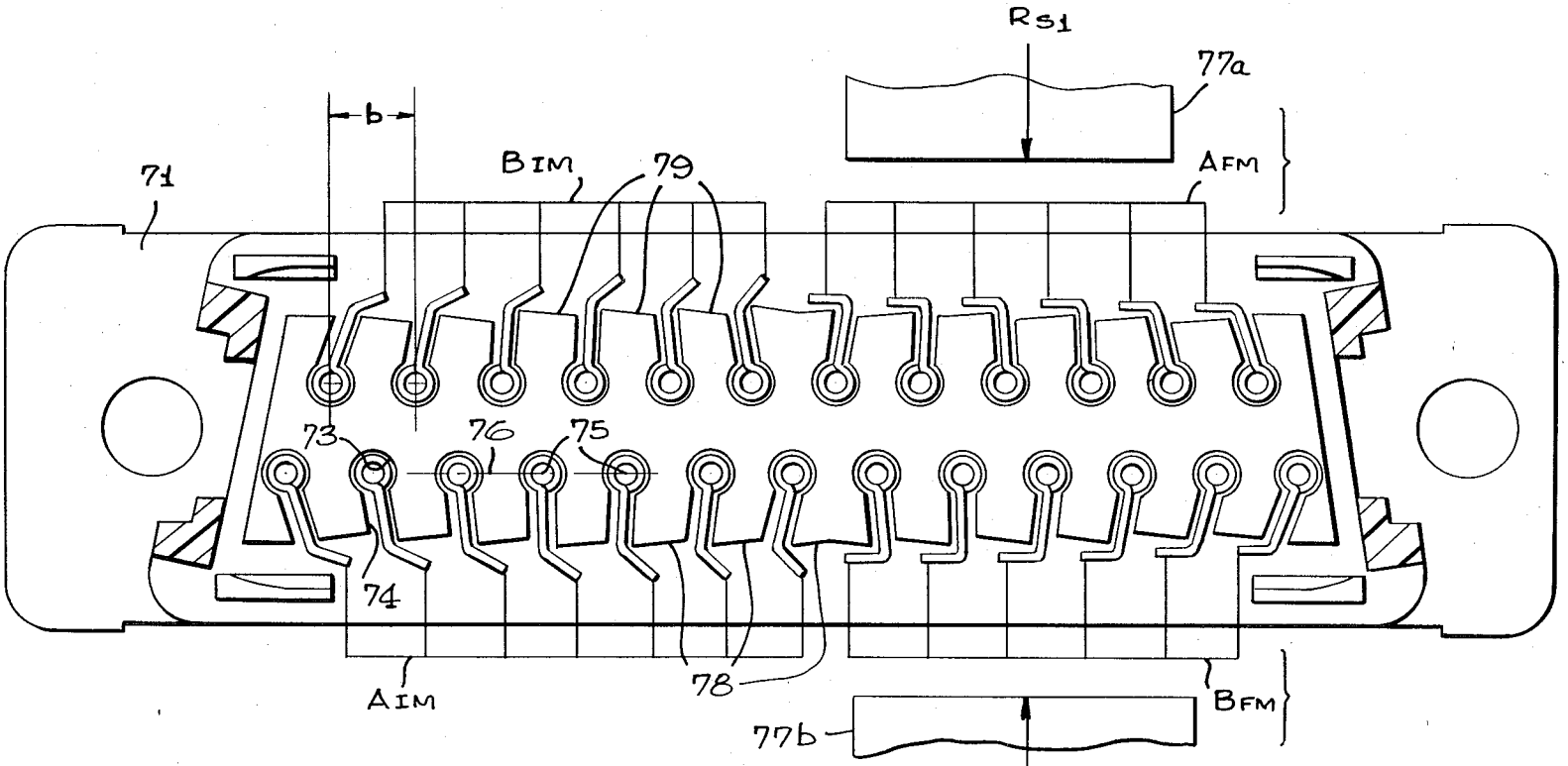

In a further forming operation, connecting part 3 is initially bent on seam 14 toward middle part 4 as is more clearly shown in FIGS. 6 and 8. FIG. 6 shows the initial bending imparted to connecting part 3 towards middle part 4. This embodiment is referred to as design $A_{IF}$. FIG. 8 shows connecting part 3 bent in a clockwise direction toward middle part 4 and this embodiment is identified as design $B_{IF}$. As will be seen, connecting parts 3 will be further bent in a counterclockwise direction for design A and in the clockwise direction for design B during subsequent forming steps after being disposed in chambers 53. The embodiments of contacts 1 with connecting parts 3 in their final positions are referred to as design $A_{FF}$ and design $B_{FF}$, respectively.

When bending connecting parts 3, axes 5 and 6 remain parallel to each other. Thus the axis of seam 14 is preferably parallel to both the major axis 5 of contact part 2 and the axis 6 of connecting part 3.

FIGS. 10 and 11 are sectional views taken through part 2 at the places indicated in FIG. 3.

FIGS. 12–20 are generally similar to FIGS. 2–11, but show the various stages in manufacturing the male contact element 21 as opposed to the female contact element 1. The reference numerals in FIGS. 12–20, where they correspond to the similar elements in FIGS. 2–11, have been incremented by the number twenty. For example, while the punching strip of FIG. 2 is identified by the numeral 20, the punching strip of FIG. 12 is identified by the numeral 40 for the sake of clarity. Thus, FIG. 12 shows outlines of an unfinished male contact element 21 which is stamped out of a punching strip 40. The male contact element 21 includes a contact part 22, a connecting part 23 and a middle part 24 positioned between the two and running essentially perpendicularly to the axes 25 and 26 of same. During the following forming steps, the male contact element 21 preferably remains connected to the punching strip 40 by means of plate 39. The contact part 22 is bent so as to form a pin as shown in FIGS. 13-15. In a further operation the connecting part 23, which is slitted at its distal end to define two terminal parts 29 and 30 for later reception of a conductor, is initially bent somewhat along seam 34 toward the middle part 24 of the contact element 21 as shown in FIGS. 16 and 18. The connecting part 23 is bent in a counterclockwise direction toward an initial position as shown in FIG. 16 (design $A_{IM}$) or in a clockwise direction toward an initial position as shown in FIG. 18 (Design $B_{IM}$). Thereafter, during subsequent forming steps yet to be described, contacting parts 23 are further bent in the respective counterclockwise and clockwise directions to final positions as shown in FIGS. 17 (Design $A_{FM}$) and FIG. 19 (Design $B_{FM}$). During these bending operations, axes axis 25 to 26 of contact part 22 and connecting part 23 remain parallel to each other.

FIG. 20 shows a sectional view through contact element 21 taken as shown in FIG. 14 along line 20—20.

Figure 21:
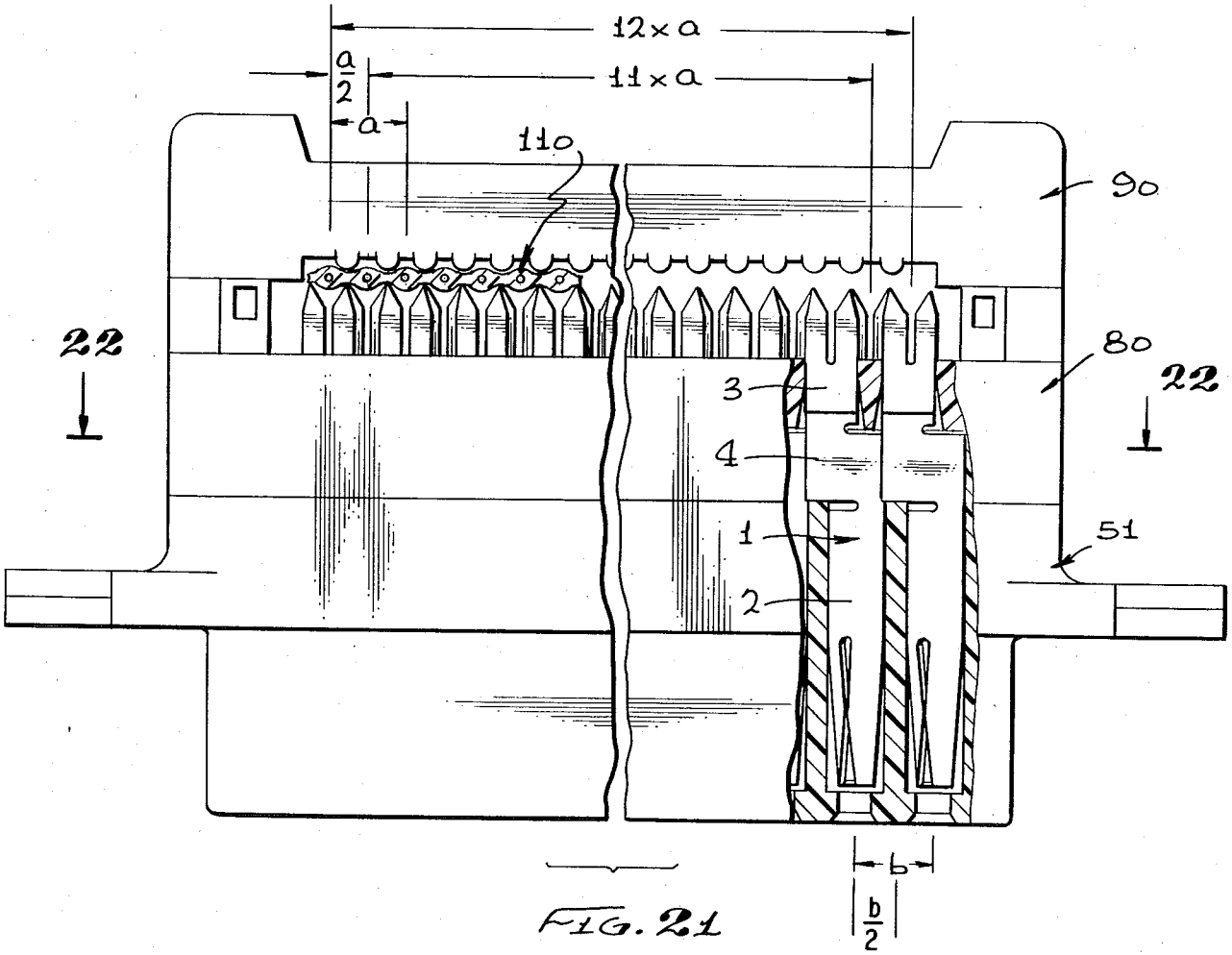
FIG. 21 is a side-elevational view of the connector body with a partially cut away section view showing female contact members therein.
Figure 22:
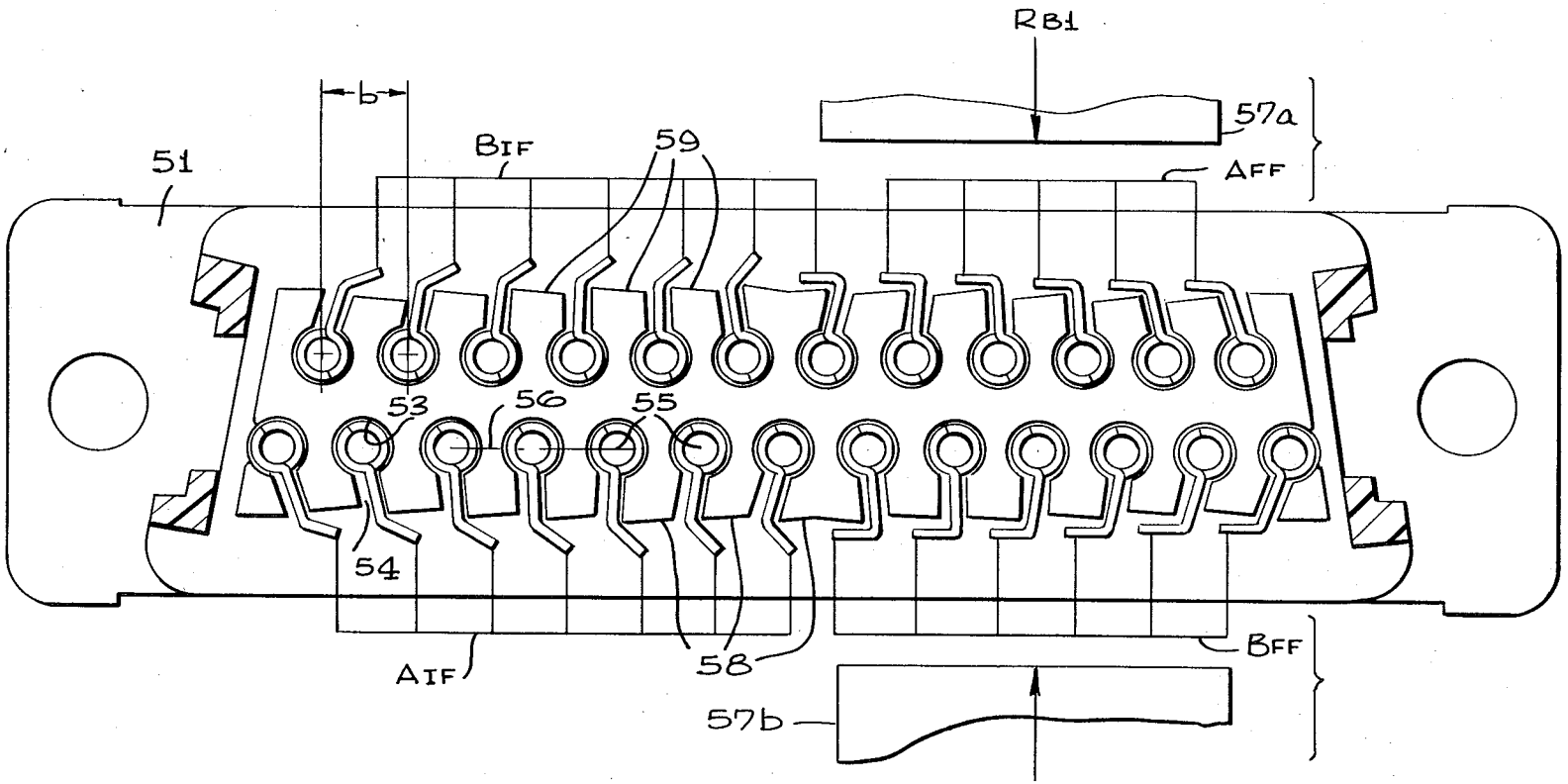
FIG. 22 is a sectional view through the connector taken as shown in FIG. 21 but with holding part 80 first removed from the connector.

Turning to FIGS. 21 and 22, after shaping the contact element according to FIG. 2 as shown in FIGS. 3–11, it is separated from punching strip 20 and preferably conveyed to a magazine (not shown) of an automatic assembly machine. The contact elements are preferably inserted by the automatic assembly machine into contact chambers 53 in an insulating body 51 so that in each case the contact parts 2 come to rest in the contact chambers 53 while the connecting parts 3 protrude out of the contact chambers 53, and the middle parts are disposed in slits or grooves 54. Slits 54 are directed radially out of the contact chambers 53 to an outer surface 59 of the insulating body 51. When installing the contact elements 1 in the contact chambers 53, the connecting parts 3, which are initially bent according to Design A (FIG. 6) or Design B (FIG. 8) should assume the correct position as shown in FIG. 22. In FIG. 22, the left side of the lower row of contact elements are shown with connecting parts 3 initially bent in accordance with Design A and designated by $A_{IF}$, while the left half of the upper row of contact elements 1 are shown with connecting parts 3 initially bent in accordance with Design B, and designated by $B_{IF}$.

In the right-hand half of FIG. 22, the female contact elements are positioned symmetrically with regard to the left half thereof and are shown with their respective connecting parts 3 after being bent into their final positions. This is preferably accomplished in one operation by means of two open dies 57*a* and 57*b*, which press from both sides against especially preformed surfaces 58 on the outer surface 59 of insulating body 51. The right side of the upper row of contact elements 1 are shown with the connecting parts 3 thereof bent to the final position for Design A and designated by $A_{FF}$. Similarly, the right side of the lower row of contact elements 1 are shown with the connecting parts thereof bent into the final position per Design B and designated by $B_{FF}$. The surfaces 58 are formed with appropriately inclined surfaces, the slopes of these surfaces being selected so that when the connecting parts 3 are bent by means of dies 57*a* and 57*b* to their final positions, they may be bent beyond their final desired position. Due to the tendency of the connecting parts to spring back somewhat after the pressing operation, they thereafter assume the desired positions of alignment with respect to each other as shown in the right half of FIG. 22.

As can be seen in FIG. 22, the slits 54 communicating between contact chambers 53 and surfaces 58 are disposed at differing angles along each row of contact elements. This permits the longitudinal spacing of the contact parts 2 to be different from the longitudinal spacing of the connecting parts 3. Typically, the spacing of the male and female members of a plug connector may be on the order of 2.77 millimeters in each row or 1.38 millimeter spacing overall whereas the spacing of the conductors for flat cables readily available in the market is 1.27 millimeters for adjacent conductors.

Turning to FIG. 21, there are shown a side partially cutaway view of the connector. As can be seen, the spacing of connector parts 2 in any given row is "b", while the overall longitudinal spacing is b/2. At the same time, spacing between adjacent connecting parts 3 in any given row is "a", whereas the overall spacing between connecting parts 3 is a/2.

Figure 23:
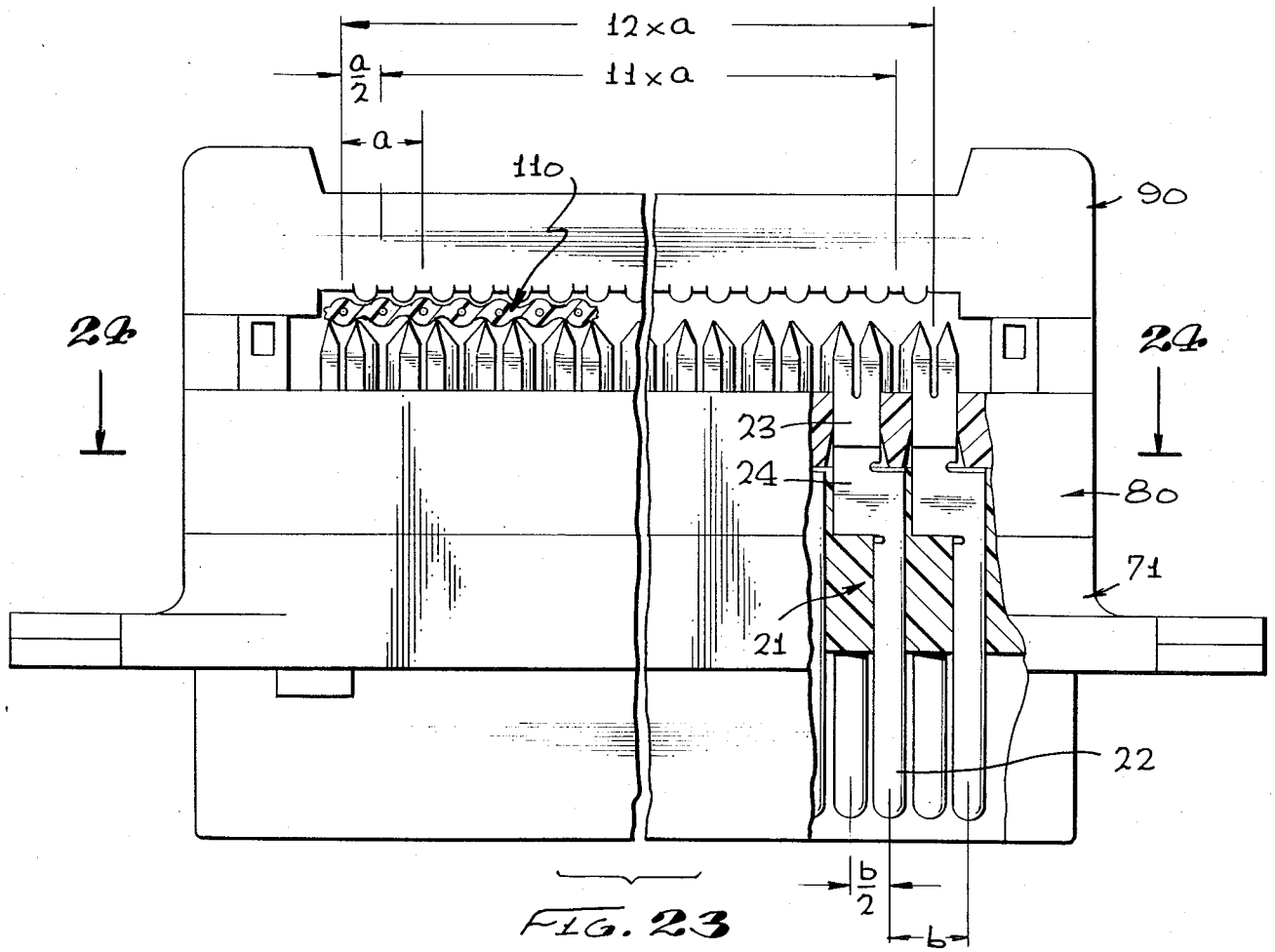
FIG. 23 is a side-elevational view of the connector body with a partially cut away view section the male contact members therein.

FIGS. 23 and 24 are generally similar to FIGS. 21 and 22 but show the male contact elements 21, as opposed to female contact elements 1, disposed in the connector body. Again, the reference numerals for similar elements are incremented by twenty for ease of understanding. Of course, the male contact elements 21 are separated from their punching strip 40 and conveyed to another magazine (also not shown) of an automatic assembly machine. The assembly machine directs the male contact elements 21 into the contact chamber 73 of insulating body 71 in such a way that the contact parts 22 come to rest in contact chamber 73 while the connecting parts 23 protrude out of contacts chambers 23 with the middle parts thereof being located in slits 74. These slits 74 are directed radially out of the contact chambers 73 to the outer surface 79 of insulating body 71. Again, the appropriate Design A or B of the contact element 21 must be disposed in the appropriate contact chambers 73 as shown in FIG. 24. Dies 77*a* and 77*b* are preferably used in a single operation to bend connecting portions 23 against surfaces 79 and surfaces 79 are separately inclined so that each connecting part 23 may be bent beyond its desired final position and thereafter spring back to the final desired position after the pressing operation performed by dies 77*a* and 77*b* has been completed.

Figure 25:
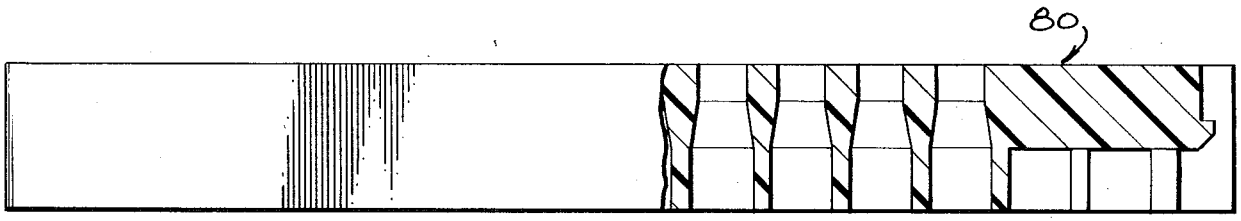
FIGS. 25 and 26 are a side-sectional view and plan view, respectively, of holding part 80.
Figure 26:
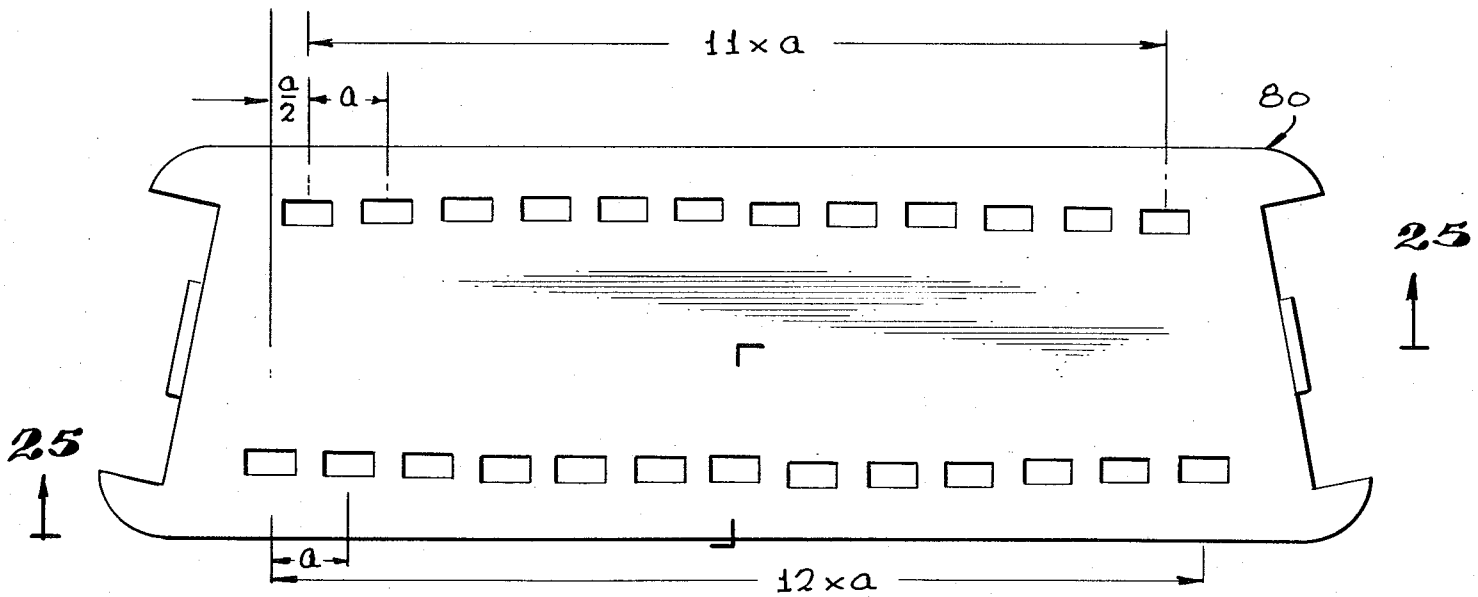
Figure 27:
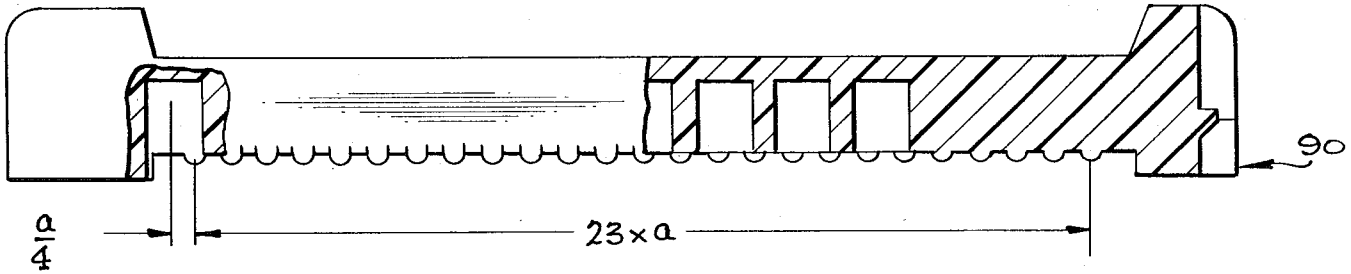
FIGS. 27 and 28 are a partially cut-away side sectional view and a plan view of pressure piece 90.
Figure 28:
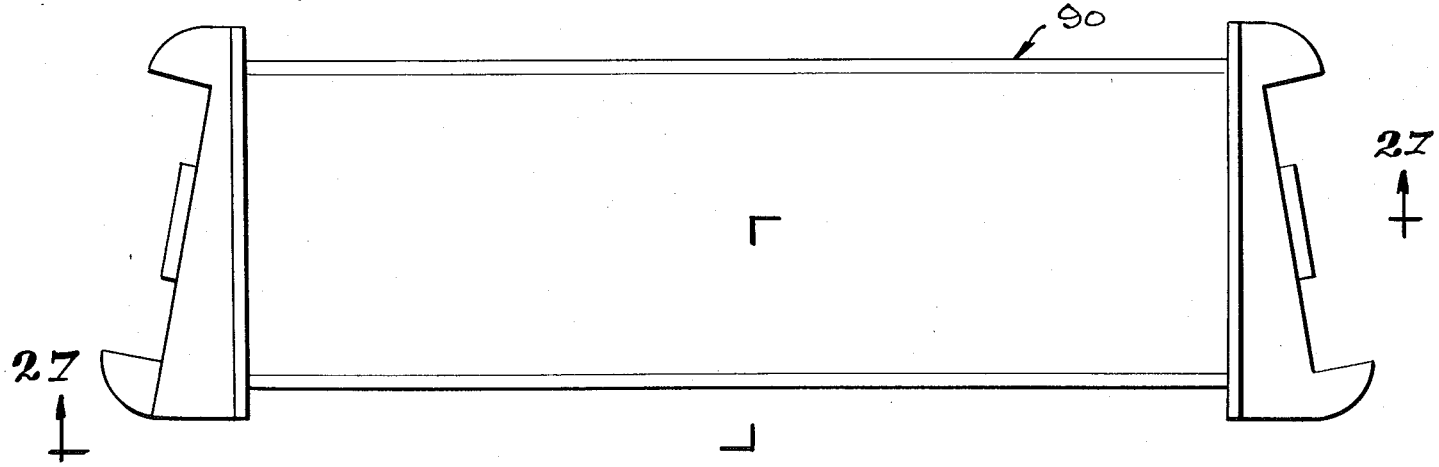

After the pressing operations have been completed for either the female connector embodiment of FIGS. 21–22 or the male connector embodiment of FIGS. 23–24, the holding part 80 shown in FIGS. 25 and 26 is placed over insulating bodies 51 and 71 so as to hold the associated connector elements in place. As has previously been described with respect to FIG. 1, a pressure piece 90 and a retaining clip 100 are preferably employed to secure flat cable 110 to either the male connector as shown in FIG. 1 or similarly, to the female connector embodiment of FIGS. 21–22.

The above-described connector has twenty-five contact elements 1, 21 which are staggered alternately in two rows. The connecting parts 3, 23 are spaced on an interval of "a" in each row and since the rows are staggered or offset, the overall spacing is a/2. On the other hand, the spacing of contact parts 2, 22 is "b" for each row or b/2 overall.

Of course, the number of contact elements and the spacings a and b may be arbitrarily selected, as has been previously mentioned, in addition to preferably having twenty-five contact elements 1, 21, spacing "a" is preferably equal to 2.54 mm while spacing "b" is preferably equal to 2.77 millimeters.

Having described the invention in connection with a specific embodiment thereof, further modification may now suggest itself to those skilled in the art. It is to be understood that this invention is not limited to specific embodiments disclosed, except as set forth in the appended claims.

What is claimed is:

1. A method of manufacturing an electrical connector for a flat cable, comprising the steps of: forming an insulating body with contact chambers therein; forming a plurality of contact elements, each contact element having a contact part for contacting with other connectors and extending along a first major axis, a connecting part for coupling to the flat cable and extending along a second major axis which is essentially parallel to said first axis, and a middle part connecting the contact part and the connecting part and extending along a third major axis which is essentially perpendicular to said first axis; inserting said contact elements into said contact chambers; and bending the connecting part of each contact element after insertion of each contact element into said contact chambers about the intersection of said connecting part and said middle part of said contact element.

2. A method of manufacturing an electrical connector for a flat cable, comprising the steps of:

forming an insulating body with contact chambers therein;

forming a plurality of contact elements from a punching strip while the elements are still connected to the punching strip, each contact element having a contact part for contacting with other connectors, a connecting part for coupling to the flat cable and a middle part connecting the contact part and the connecting part;

bending the connecting parts of the elements to one of two predetermined initial positions prior to insertion of said elements into said contact chamber;

inserting said contact elements into said contact chambers;

said contact chambers being arranged in said insulating body with axes parallel to each other and along at least one straight line, each contact chamber being provided with a groove leading radially to an outer surface of the insulating body for receiving the middle part of the contact element when the contact element is inserted into said chamber, said outer surface being formed with predetermined inclined surfaces; and bending the connecting parts against said surfaces by means of opened dies after insertion of each contact element into said contact chambers about an axis which is essentially parallel to a major axis of the contact part of each contact element, the predetermined inclined surfaces being selected so that after the connecting parts are bent against the inclined surfaces they thereafter spring back and assume their final desired positions.

3. The method according to claim 2 wherein said chambers in the insulating body are arranged in two rows along two straight lines and wherein the final positions of said connecting parts are spaced laterally from each other in an amount equal to twice the spacing of conductors in the flat cable.

4. A method of manufacturing an electrical connector for a flat cable, comprising the steps of: forming an insulating body with contact chambers therein; forming a plurality of contact elements from a punching strip while the elements are still connected to the punching strip, each contact element having a contact part for contacting with other connectors and extending along a first major axis, a connecting part for coupling to the flat cable and extending along a second major axis which is essentially parallel to said first axis, and a middle part connecting the contact part and the connecting part and extending along a third major axis which is essentially perpendicular to said first axis; bending the connecting parts of the elements to one of two predetermined initial positions prior to insertion of said elements into said contact chambers, wherein in one of said positions, the connecting part is bent in a clockwise direction, with reference to the intersection of said connecting part and said middle part, towards the middle part, and in the other position of said positions, the connecting part is bent in a counterclockwise direction, with reference to the intersection of said connecting part and said middle part, towards said middle part; inserting said contact elements into said contact chambers; and bending the connecting part of each contact element after insertion of each contact element into said contact chambers about an axis which is essentially parallel to said first major axis of the contact part of each contact element.

5. The method according to claim 4, wherein the contact chambers formed in the insulating body are arranged with axes parallel to each other and along at least one straight line, each contact chamber being provided with a groove leading radially to an outer surface of the insulating body for receiving the middle part of the contact element when the contact element is inserted into said chamber, and wherein said outer surface is formed with predetermined inclined surfaces, and bending the connecting parts against said surfaces, the predetermined inclined surfaces being selected so that after the connecting parts are bent against the inclined surfaces they thereafter spring back and assume their final desired positions.

6. The method according to claim 5, wherein the chambers in the insulating body are arranged in two rows along two straight lines and wherein the final positions of said connecting parts are spaced laterally from each other in an amount twice the spacing of conductors in the flat cable.

7. The method according to claim 4, wherein the contact chambers formed in the insulating body are arranged with axes parallel to each other and along at least one straight line, each contact chamber being provided with a groove leading radially to an outer surface of the insulating body for receiving the middle part of the contact element when the contact element is inserted into said chamber, each groove being disposed at a different angle than its adjacent groove.

8. An electrical connector for a flat cable, the connector comprising: a plurality of contact elements and a insulating body having chambers therein for receiving the contact elements, said contact elements being preformed prior to insertion in said chambers, each contact element having a contact part for contacting other connectors, a connecting part for coupling to the flat cable and a middle part connecting the contact part and the connecting part, said connecting part being formed by first prebending the connected parts to one of two predetermined initial positions and by bending about an axis which is essentially parallel to a major axis of the contact part after the associated contact element is received in its associated contact chamber, said contact chambers being arranged with major axes parallel to each other and along at least oen straight line, each contact chamber including a groove leading radially to an outer surface of the insulating body for receiving the middle part of the contact element and wherein the connecting part which is bent to its initial position projects radially out of the groove after the contact element is inserted in its respective contact chamber, the outer surface including specially inclined surfaces for limiting the distance the connecting part may be forced during a pressing operation, the inclination of the inclined surface being selected such that the connecting part after being forced against the inclined surface thereafter springs back to its final desired position.

9. The connector according to claim 8 wherein said contact chambers are arranged in two straight rows in said insulating body and wherein the final positions of said connecting parts are laterally spaced from each other by a distance equal to twice the spacing of conductors in said flat cable.

10. An electrical connector for a flat cable, the connector comprising: a plurality of contact elements and an insulating body having chambers therein for receiving the contact elements, each contact element having a contact part for contacting with other connectors and extending along a first major axis, a connecting part for coupling to the flat cable and extending along a second major axis which is essentially parallel to said first major axis, and a middle part connecting the contact part and the connecting part extending along a third major axis which is essentially perpendicular to said first axis and the connecting part being formed by bending about an axis which is essentially parallel to said first major axis of the contact part after the associated contact element is received in its associated contact chamber, wherein the contact chambers formed in the insulating body are arranged with axes parallel to each other and along at least one straight line, each contact chamber being provided with a groove leading radially to an outer surface of the insulating body for receiving the middle part of the contact element when the contact element is inserted into said chamber, each groove being disposed at a different angle than its adjacent groove.

11. The electrical connector as claimed in Claim 10, wherein the contact elements are preformed prior to insertion in said chambers, the preformed contact elements including connecting parts which are bent to one of two predetermined initial positions, wherein in one of said positions, the connecting part is bent in a clockwise direction, with reference to the intersection of said connecting part and said middle part, towards the middle part, and in the other position of said positions, the connecting part is bent in a counterclockwise direction, with reference to the intersection of said connecting part and said middle part, towards said middle part.

12. The connector as claimed in Claim 10, wherein the connecting part which is bent to its initial position projects radially out of the groove after the contact element is inserted in its respective contact chamber, the outer surface including specially inclined surfaces for limiting the distance the connecting part may be forced during a pressing operation, the inclination of the inclined surface being selected such that the connecting part after being forced against the inclined surface thereafter springs back to its final desired position.

13. The connector according to claim 12, wherein said contact chambers are arranged in two straight rows in said insulating body and wherein the final positions of said connecting parts are laterally spaced from each other by a distance equal to twice the spacing of conductors in said flat cable.

14. The connector as claimed in claim 10 wherein said insulating body has a major axis and wherein in their final positions in said connector the connecting parts extend in a direction essentially parallel to the major axis of said body.

15. The connector as claimed in claim 14 wherein said connecting part includes an insulation displacing contact.

* * * * *